US012017811B2

(12) United States Patent
Kodaira et al.

(10) Patent No.: US 12,017,811 B2
(45) Date of Patent: Jun. 25, 2024

(54) METAL COIL COMPRESSION BINDING APPARATUS

(71) Applicant: KYODO SPECIAL STEEL WIRE CO., LTD., Iruma (JP)

(72) Inventors: Hideaki Kodaira, Iruma (JP); Koji Matsumoto, Iruma (JP)

(73) Assignee: KYODO SPECIAL STEEL WIRE CO., LTD. (JP)

( * ) Notice: Subject to any disclaimer, the term of this patent is extended or adjusted under 35 U.S.C. 154(b) by 427 days.

(21) Appl. No.: 17/424,385

(22) PCT Filed: Jan. 21, 2020

(86) PCT No.: PCT/JP2020/001830
§ 371 (c)(1),
(2) Date: Jul. 20, 2021

(87) PCT Pub. No.: WO2020/153320
PCT Pub. Date: Jul. 30, 2020

(65) Prior Publication Data

US 2022/0111982 A1 Apr. 14, 2022

(30) Foreign Application Priority Data

Jan. 24, 2019 (JP) ..... 2019-000211

(51) Int. Cl.
*B25B 5/00* (2006.01)
*B65B 13/20* (2006.01)
*B65B 27/06* (2006.01)

(52) U.S. Cl.
CPC ..... *B65B 13/20* (2013.01); *B65B 27/06* (2013.01)

(58) Field of Classification Search
CPC ..... B25B 5/00; B25B 5/006; B25B 5/067; B25B 5/101; B25B 5/082; B25B 27/00; B25B 27/14; B25B 27/26
See application file for complete search history.

(56) References Cited

U.S. PATENT DOCUMENTS 5,680,686 A * 10/1997 Bosche ..... B25B 27/304 29/227
7,103,951 B2 * 9/2006 Uzun ..... B25B 27/0035 29/227

(Continued)

FOREIGN PATENT DOCUMENTS

JP S49-063594 A 6/1974
JP 2003-040211 A 2/2003

(Continued)

OTHER PUBLICATIONS

International Search Report (English and Japanese) of the International Searching Authority issued in PCT/JP2020/001830, dated Mar. 17, 2020; ISA/JP (5 pages).

*Primary Examiner* — Lee D Wilson
(74) *Attorney, Agent, or Firm* — Harness, Dickey & Pierce, P.L.C.

(57) ABSTRACT

A metal coil compression device includes: a lifting device configured to generate a vertically downward pressing force; a cylindrical outer pressure barrel that is supported by the lifting device; a cylindrical inner pressure barrel that is located inside a peripheral wall of the outer pressure barrel; and a connecting mechanism that connects the inner and outer pressure barrels so that the inner and outer pressure barrels are vertically engaged and are supported relatively rotatably in a circumferential direction. The outer pressure barrel has an outer recess being recessed vertically upward from a bottom end. The inner pressure barrel has an inner recess in a peripheral wall of the inner pressure barrel, the (Continued)

inner recess being recessed vertically upward from a bottom end, and a coil pressing surface that makes contact with a top of the metal coil to transmit the vertically downward pressing force to the metal coil.

4 Claims, 5 Drawing Sheets

(56) References Cited

U.S. PATENT DOCUMENTS

| | | | | |
|---|---|---|---|---|
| 7,814,629 | B2 * | 10/2010 | Uzun | B25B 27/304 269/902 |
| 8,112,856 | B2 * | 2/2012 | Huang | B25B 27/304 29/230 |
| 2003/0184105 | A1 | 10/2003 | Jones et al. | |
| 2022/0111982 | A1 * | 4/2022 | Kodaira | B21C 47/24 |

FOREIGN PATENT DOCUMENTS

| | | | |
|---|---|---|---|
| JP | 2003-285802 | A | 10/2003 |
| JP | 4095817 | B2 | 6/2008 |

* cited by examiner

METAL COIL COMPRESSION BINDING APPARATUS

CROSS REFERENCE TO RELATED APPLICATIONS

This application is a U.S. National Phase Application under 35 U.S.C. 371 of International Application No. PCT/JP2020/001830, filed on Jan. 21, 2020, which claims priority to Japanese Patent Application No. 2019-000211U, filed on Jan. 24, 2019. The entire disclosures of the above applications are expressly incorporated by reference herein.

BACKGROUND

Technical Field

The present invention relates to a metal coil compression binding apparatus that is an apparatus configured to compress a metal coil and bind the compressed metal coil with binding bands.

Related Art

Continuous metal wires of carbon steel, brass, and the like manufactured by rolling at steel plants are delivered to secondary processing manufacturers, and processed into product materials such as springs for use in automobiles through a wire drawing process, an annealing process, and a surface treatment. The secondarily processed wires are wound in a coil shape, compressed in a center axis direction, and bound with metal straps (i.e., steel strips, binding bands) upon shipment.

There have conventionally been apparatuses configured to compress and bind metal coils (for example, see Japanese Patent No. 4095817).

FIG. 6(A) is an explanatory diagram of a conventional metal coil compression binding apparatus 125. A metal coil 120 is wound around a carrier 115 and placed on the compression binding apparatus 125. The compression binding apparatus 125 includes shoots 140 that guide and caulk a steel strip 130, a head 157 that performs feeding, tightening, and cutting of the strap, a pressing surface 135 that axially compresses the metal coil 120, and a hydraulic cylinder 155 that generates a pressing force. Here, a lower shoot 140B and the hydraulic cylinder 155 are installed in a pit dug in the ground.

FIG. 6(B) is an explanatory diagram showing a mode where the metal coil 120 is compressed and bound by the compression binding apparatus 125. The metal coil 120 is axially compressed by the hydraulic cylinder 155 via the pressing surface 135. The binding band 130 is then guided to the inside of the metal coil 120 by the shoots 140 and fastened.

However, using the fixed system of digging a pit in the ground makes it impossible to accommodate with layout changes of the devices and the like in the plant. The large scale of the device and poor usability have also been problems. Furthermore, manual binding for device miniaturization makes the operation dangerous.

In view of the foregoing circumstances, the present invention is directed to providing a movable small-sized metal coil self-compression binding apparatus.

SUMMARY (1) The present invention provides a metal coil compression device configured to axially compress a metal coil placed with an axis thereof vertical to bind the metal coil with a binding band, the metal coil compression device including: a lifting device configured to generate a vertically downward pressing force; a cylindrical outer pressure barrel that is supported by the lifting device so that it can move vertically and has an opening opened vertically downward on a bottom thereof; a cylindrical inner pressure barrel that is located inside a peripheral wall of the outer pressure barrel; and a connecting mechanism that is located between the inner pressure barrel and the outer pressure barrel, and connects the inner and outer pressure barrels so that the inner and outer pressure barrels are vertically engaged and are supported relatively rotatably in a circumferential direction. The outer pressure barrel has an outer recess in the peripheral wall of the outer pressure barrel, the outer recess being recessed vertically upward from a bottom end. The inner pressure barrel has an inner recess in a peripheral wall of the inner pressure barrel, the inner recess being recessed vertically upward from a bottom end, and a coil pressing surface that is located at the bottom end of the peripheral wall of the inner pressure barrel and makes contact with a top of the metal coil to transmit the vertically downward pressing force to the metal coil.

According to the invention set forth in the foregoing (1), a binding band insertion portion of a binding device that binds the metal coil with the binding band can be inserted through the respective recesses in the outer pressure barrel and the inner pressure barrel with the pressing force applied to the metal coil. This provides an excellent effect that the steel strip (binding band) can be inserted into the inside of the metal coil, and the metal coil can be safely and reliably compressed and bound.

(2) The present invention provides the metal coil compression device according to the foregoing (1), wherein the inner pressure barrel has a plurality of the inner recesses in the circumferential direction.

According to the invention set forth in the foregoing (2), there are a plurality of inner recesses in the circumferential direction of the inner pressure barrel. The binding band insertion portion can thus be inserted into the inner pressure barrel in a plurality of directions when the metal coil is rotated. This can provide an excellent effect that the metal coil can be reliably bound in a plurality of directions with a plurality of steel strips.

(3) The present invention provides the metal coil compression device according to the foregoing (1) or (2), further including: a placing table on which the metal coil is placed; and a rotation mechanism configured to rotate the placing table with the inner pressure barrel.

According to the invention set forth in the foregoing (3), a metal coil as heavy as several tons can be mechanically rotated, and the steel strip binding can be performed by inserting the binding band insertion portion only in a predetermined direction. This provides an excellent effect that the metal coil can be safely bound without manual intervention.

(4) The present invention provides a metal coil compression binding apparatus, wherein, regarding the metal coil compression device according to any one of the foregoing (1) to (3), a binding device is further included that binds the metal coil placed with an axis thereof vertical with the binding band. The binding device includes a binding band insertion portion configured to insert the binding band into both the outer recess and the inner recess.

According to the invention set forth in the (4), the binding band insertion portion of the binding device configured to bind the metal coil with the binding band is inserted through the respective recesses in the outer pressure barrel and the inner pressure barrel with the pressing force applied to the metal coil. The metal strip (binding band) can thus be inserted into the inside of the metal coil, and the metal strip can be mechanically fastened. This provides an excellent effect that the metal coil can be safely and reliably compressed and bound.

Advantageous Effects of Invention

According to the metal coil compression device and the metal coil compression binding apparatus set forth in claims 1 to 4 of the present invention, the binding band insertion portion of the binding device can be inserted through the respective recesses in the outer pressure barrel and the inner pressure barrel with the pressing force applied to the metal coil. The steel strip (binding band) can thus be inserted into the inside of the metal coil, and the metal band can be mechanically fastened. This provides an excellent effect of enabling safe, reliable compression and binding.

DETAILED DESCRIPTION

Figure 1:
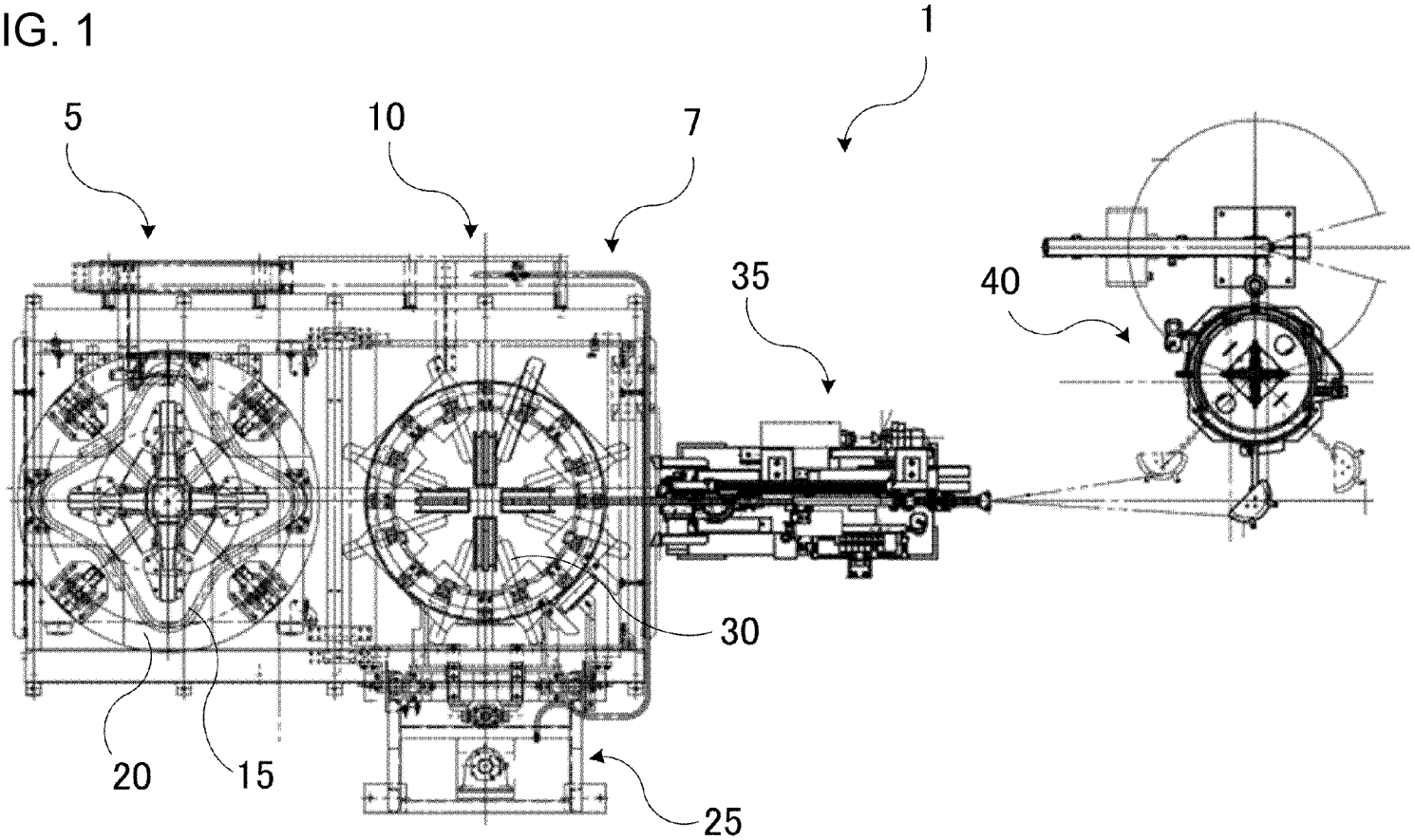
FIG. 1 is a top view of a metal coil compression binding apparatus according to an embodiment of the present invention.

An embodiment of the present invention will be described below with reference to the accompanying drawings.

FIGS. 1 to 5 show an example of a mode for carrying the invention. In the diagrams, parts designated by the same reference numerals represent the same components. A basic configuration is similar to the conventional one shown in the diagram.

FIG. 1 is an explanatory diagram of a metal coil compression binding apparatus 1 according to the embodiment of the present invention. The metal coil compression binding apparatus 1 includes a metal coil compression device 7 including a metal coil setting area 5 where the direction of a metal coil 20 is changed and a metal coil compression binding area 10 where the metal coil is compressed and bound, and a binding device 35. The metal coil compression binding area 10 includes a lifting device 25, and a metal coil compression unit 75 is moved up and down to compress the metal coil 20 via coil pressing surfaces 30. A steel strip for use in the binding device 35 is transported by a jib crane 40.

Specifically, the metal coil compression binding apparatus 1 includes the metal coil compression device 7 that axially compresses the metal coil 20 placed with its axis vertical, and the binding device 35 that binds the metal coil 20 with binding bands. The metal coil compression device 7 includes the lifting device 25 that generates a vertically downward pressing force, a cylindrical outer pressure barrel 50 (see FIG. 2(A) to be described below) that is supported by the lifting device 25 so that it can move vertically and has an opening 63 (see FIG. 4(A) to be described below) opened vertically downward at the bottom, a cylindrical inner pressure barrel 45 (see FIG. 2(A) to be described below) that is located inside a peripheral wall of the outer pressure barrel 50, and connecting mechanisms 53 (see FIG. 2(A) to be described below) that are located between the inner pressure barrel 45 and the outer pressure barrel 50 and connect the inner and outer pressure barrels so that the inner and outer pressure barrels are vertically engaged and supported relatively rotatably in the circumferential direction. The outer pressure barrel 50 has an outer recess 60 in the peripheral wall of the outer pressure barrel 50, the outer recess 60 being recessed vertically upward from the bottom end. The inner pressure barrel 55 has inner recesses 55 in a peripheral wall of the inner pressure barrel 45, the inner recesses 55 being recessed vertically upward from the bottom end, and the coil pressing surfaces 30 that are located at the bottom end of the peripheral wall of the inner pressure barrel 45 and make contact with the top of the metal coil 20 to transmit the vertically downward pressing force to the metal coil 20. The binding device 35 includes a binding band insertion portion 85 (see FIG. 5(A) to be described below) that inserts a binding band into both the outer recess 60 and an inner recess 55.

In terms of miniaturization, it is desirable that the lifting device 25 move the metal coil compression device 75 up and down to generate the pressing force by using servomotors. More specifically, the pressing force is preferably generated by rotating ball screws included in the lifting device 25 using servomotors. It should be understood that hydraulic pistons may be used to generate the pressing force.

Figure 2A:
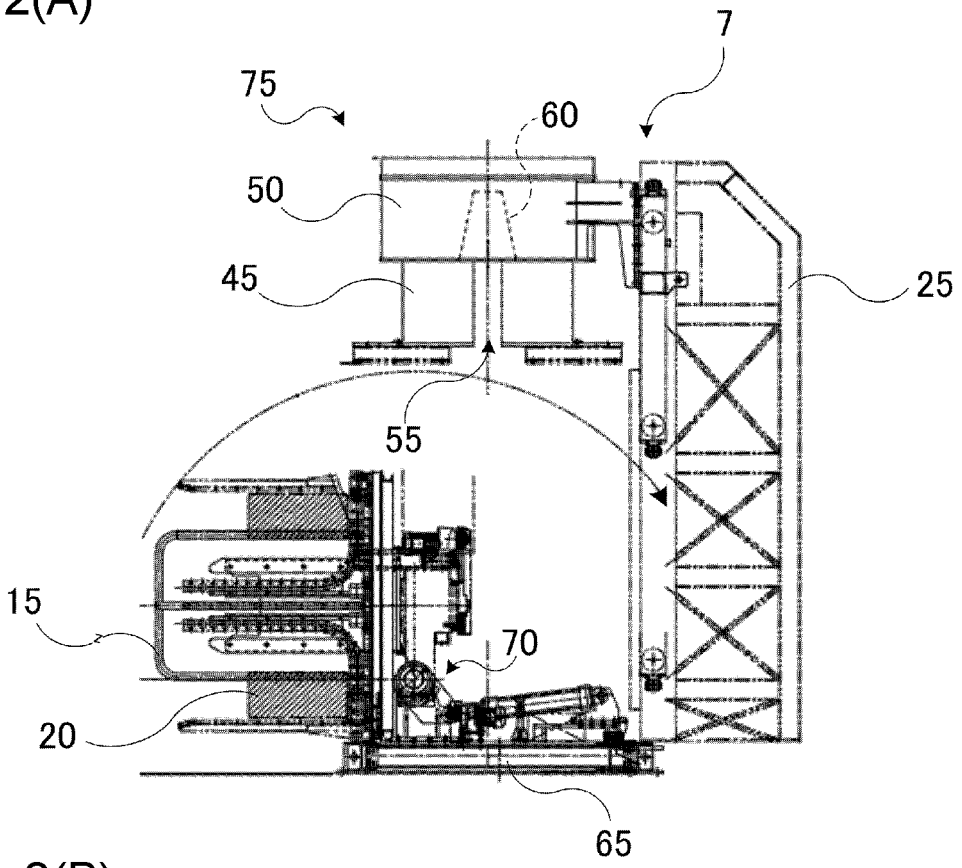
FIG. 2(A) is a side view of the metal coil compression binding apparatus.

FIG. 2(A) is a side view of the metal coil compression device 7 in the metal coil compression binding apparatus 1. The metal coil 20 is wound around a carrier 15, transported with its center axis horizontal, and placed on the metal coil setting area 5 of the metal coil compression device 7. The metal coil 20 is rotated and turned in the direction of the arrow by a cycloidal reduction gear 70 and a chain transmission, such that its center axis is vertical. The metal coil 20 is moved from the metal coil setting area 5 to the metal coil compression binding area 10 by a carriage 65.

Figure 2B:
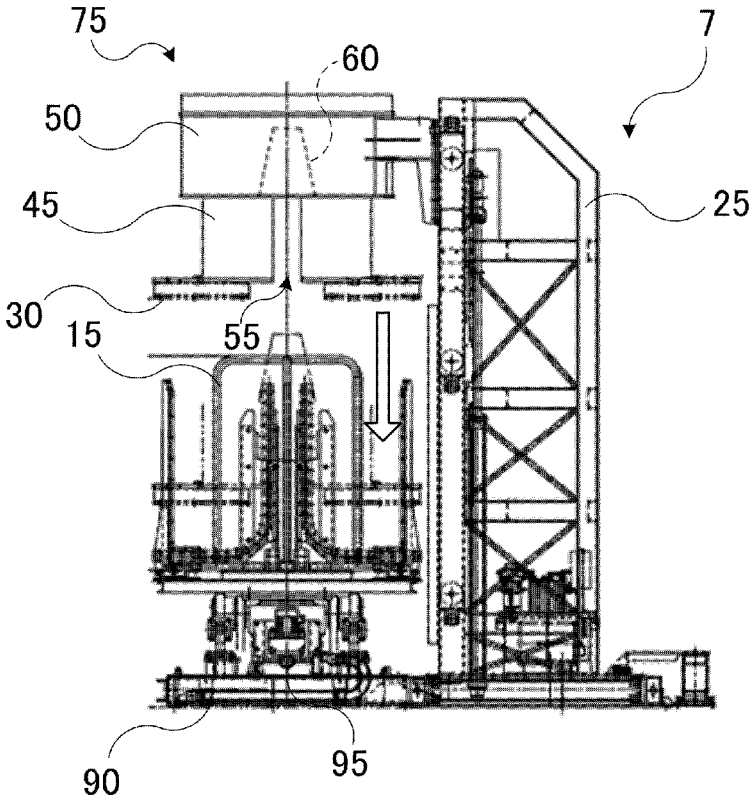
FIG. 2(B) is an explanatory diagram of a compression operation of the metal coil compression binding apparatus.

FIG. 2(B) is an explanatory diagram of a compression operation of the metal coil compression device 7 in the metal coil compression binding apparatus 1. The metal coil 20 is transported to a placing table 90 by the carriage 65. In the metal coil compression device 7, the outer recess 60 in the peripheral wall of the outer pressure barrel 50 is directed so that the binding band insertion portion 85 of the binding device 35 can be inserted thereinto. The outer pressure barrel 50 held by the lifting device 25 accommodates the inner pressure barrel 45, and the outer pressure barrel 50 and the inner pressure barrel 45 are held rotatably in the horizontal direction by the connecting mechanisms 53 (see FIG. 4 to be described below). Moving the outer pressure barrel 50 vertically up and down by the lifting device 25 generates a pressing force against the metal coil 20. Specifically, the pressing surfaces 30 located at the bottom of the inner pressure barrel 45 held by the outer pressure barrel 50 vertically press the top of the metal coil 20, whereby the metal coil 20 is compressed in the center axis direction.

The peripheral wall of the inner pressure barrel 45 has a plurality of inner recesses 55. A rotation mechanism 95 rotates the inner pressure barrel 45 with the metal coil 20 so that one of the inner recesses 55 is directed to the inserting direction of the binding band insertion portion 85 like the outer recess 60.

Specifically, the metal coil compression binding apparatus 1 further includes the placing table 90 on which the metal coil 20 is placed, and the rotation mechanism 65 that rotates the placing table 90 with the inner pressure barrel 45.

Figure 3:
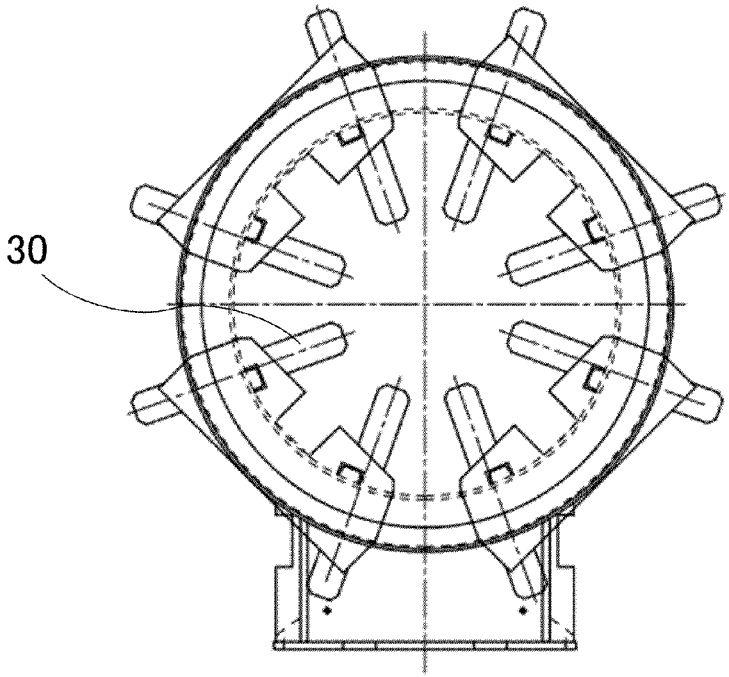
FIG. 3 is an explanatory diagram of coil pressing surfaces located at the bottom of an inner pressure barrel.

FIG. 3 is an explanatory diagram showing the coil pressing surfaces 30 located at the bottom of the inner pressure barrel 45. There are a plurality of coil pressing surfaces 30, which receive the pressing force occurring when the outer pressure barrel 50 is moved vertically downward by the lifting device 25 from the outer pressure barrel 50 and transmit the pressing force to the top of the metal coil 20.

Figure 4A:
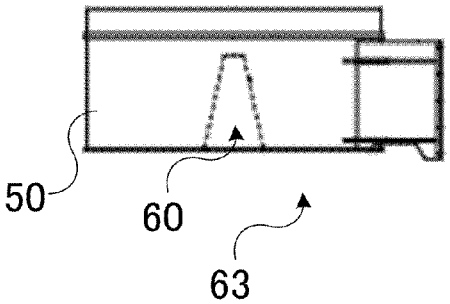
FIG. 4(A) is an explanatory diagram of an outer pressure barrel.

FIG. 4(A) is an explanatory diagram showing the outer pressure barrel 50. The outer pressure barrel 50 is cylindrical in shape and has the opening 63 opened vertically downward at the bottom. The peripheral wall of the outer pressure barrel 50 has the outer recess 60. The outer pressure barrel 50 is held by the lifting device 25 so that it can move vertically (see FIG. 3(B)).

Figure 4B:
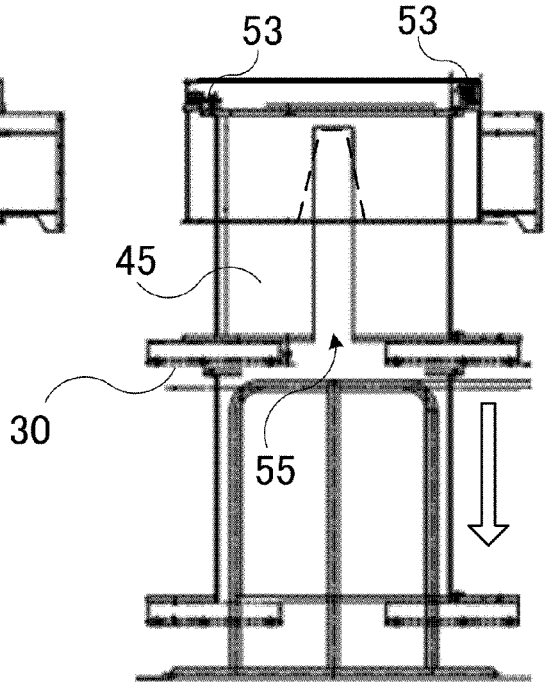
FIG. 4(B) is an operation explanatory diagram of the outer pressure barrel and the inner pressure barrel located therein.

FIG. 4(B) is an explanatory diagram of the operation of the outer pressure barrel 50 and the inner pressure barrel 45 located therein. The inner pressure barrel 45 is accommodated inside the outer pressure barrel 50 via the opening 63. The inner pressure barrel 45 is axially engaged with, and held rotatably in the circumferential direction on, the outer pressure barrel 50 by the connecting mechanisms 53. If the outer pressure barrel 50 is moved vertically downward (in the direction of the hollow arrow in FIG. 4) by the lifting device 25, the coil pressing surfaces 30 compress the metal coil 20 in the center axis direction.

The steel strip can be inserted into the inside of the metal coil 20 by aligning the positions of the outer recess 60 of the outer pressure barrel 50 and the inner recesses 55 of the inner pressure barrel 45 (see FIG. 5 to be described below).

The pressing force on the metal coil 20 may be generated by using servomotors and rolling ball screws for the lifting device 25, for example. It should be understood that hydraulic pistons and the like may be used.

Figure 5A:
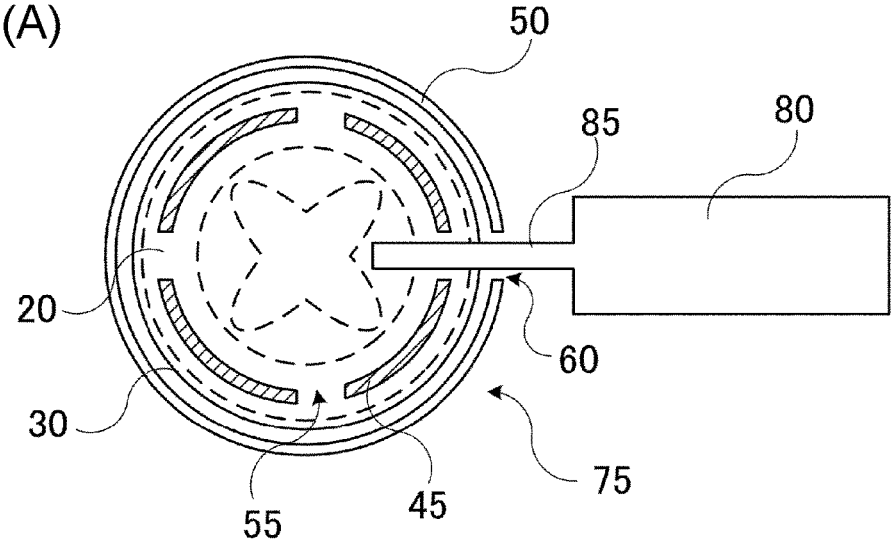
FIG. 5(A) is an explanatory diagram of an operation of a binding device and the metal coil compression device.

FIG. 5(A) is an explanatory diagram of the operation of the binding device 80 and the metal coil compression device 7. The binding band insertion portion 85 of the binding device 80 for guiding the steel strip to the metal coil 20 is inserted into the metal coil 20 through the outer recess 60 in the outer pressure barrel 50 and an inner recess 55 in the inner pressure barrel 45. After the steel strip is caulked to bind the metal coil 20 in one position, the metal coil 20 and the inner pressure barrel 45 are rotated in the circumferential direction by an angle of, e.g., 90° by the rotation mechanism 95.

The binding device 80 desirably includes a head that feeds, tightens, and cuts the steel strip (binding band, strap) like conventional binding devices.

Figure 5B:
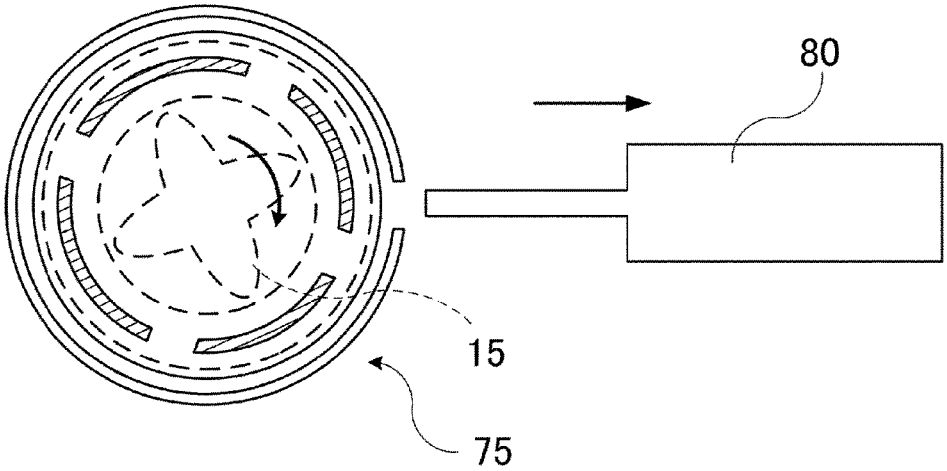
FIG. 5(B) is an explanatory diagram of an operation of the metal coil compression device where the inner pressure barrel rotates simultaneously with the metal coil.

FIG. 5(B) is an explanatory diagram of an operation of the metal coil compression device 7, where the inner pressure barrel 45 rotates simultaneously with the metal coil 20. The binding device 80 is once separated from the metal coil compression device 7 to withdraw the binding band insertion portion 85 to outside the outer pressure barrel 50, and the inner pressure barrel 45 and the metal coil 20 are rotated. The metal coil 20 is placed on the placing table 90 and rotated, for example, horizontally clockwise by the rotation mechanism 95. With the rotation of the metal coil 20, the inner pressure barrel 45 is also rotated in the circumferential on a horizontal plane by a frictional force between the top of the metal coil 20 and the bottom of the pressing surfaces 30.

Figure 5C:
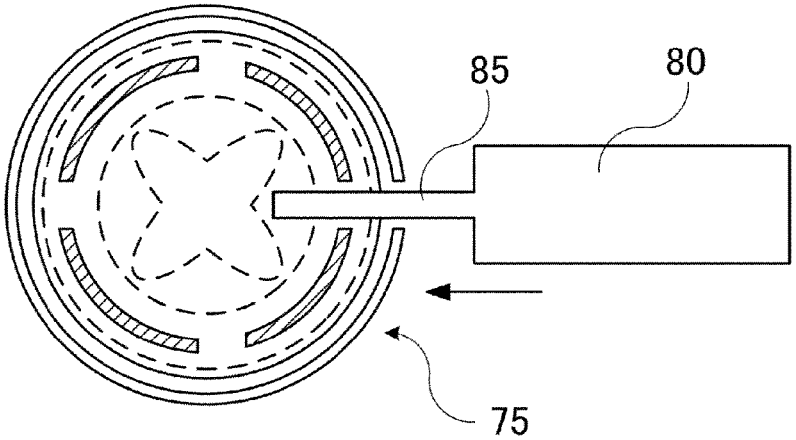
FIG. 5(C) is an explanatory diagram showing a mode where a binding band insertion portion is inserted into the metal coil compression device again.
Figure 6A:
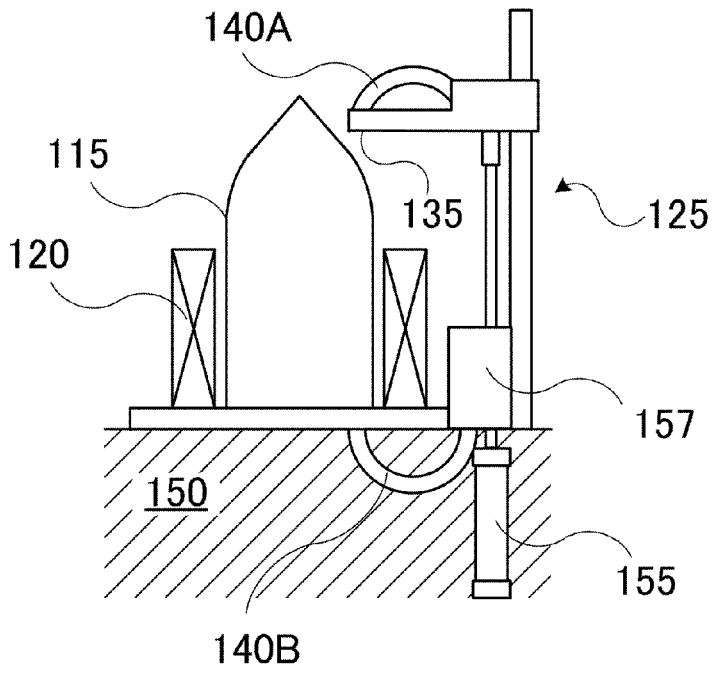
FIG. 6(A) Prior Art
FIG. 6(A) is an explanatory diagram of a conventional metal coil compression binding apparatus 125.
Figure 6B:
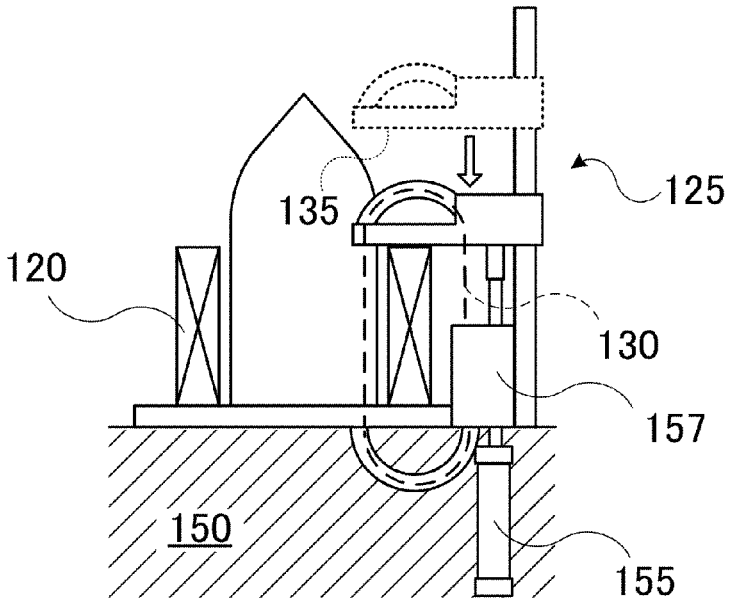
FIG. 6(B) Prior Art
FIG. 6(B) is an explanatory diagram showing a mode where a metal coil 120 is compressed and bound by the compression binding apparatus 125.

FIG. 5(C) shows a mode where the outer recess 60 in the outer pressure barrel 50 and an inner recess 55 in the inner pressure barrel 45 are aligned again and the binding band insertion portion 85 can be inserted to insert the steel strip into the inside of the metal coil 20 and fasten the steel strip.

For example, in the case of FIGS. 5(A) to 5(C), the steel strip can be fastened at regular angles of 90° in the circumferential direction of the metal coil 20.

According to the metal coil compression device 7 of the embodiment of the present invention, the binding band insertion portion 85 of the binding device for binding the metal coil 20 with a binding band can be inserted through respective recesses in the outer pressure barrel 50 and the inner pressure barrel 45 with the pressing force applied to the metal coil 20. The steel strip (binding band) can thus be inserted into the inside of the metal coil 20, and there is provided an excellent effect that the metal coil can be safely and reliably compressed and bound.

According to the metal coil compression device 7 of the embodiment of the present invention, the plurality of inner recesses 55 are located in the circumferential direction in the inner pressure barrel 45. The binding band insertion portion 85 can thus be inserted into the inner pressure barrel 45 in a plurality of directions when the metal coil 20 is rotated. This can provide an excellent effect that the metal coil 20 can be reliably bound with a plurality of steel strips in a plurality of directions.

According to the metal coil compression device 7 of the embodiment of the present invention, the metal coil 20 as heavy as several tons can be mechanically rotated. The steel strip binding can thus be performed by inserting the binding band insertion portion only in a predetermined direction. This provides an excellent effect that the metal coil 20 can be safely bound without manual intervention.

According to the metal coil compressing binding apparatus 1 of the embodiment of the present invention, the binding band insertion portion 85 of the binding device for binding the metal coil with a binding band is inserted through respective recesses in the outer pressure barrel 50 and the inner pressure barrel 45 with the pressing force applied to the metal coil. The steel strip (binding band) can thus be inserted into the inside of the metal coil 20, and the steel strip can be mechanically fastened. This provides an excellent effect that the metal coil can be safely and reliably compressed and bound.

It should be understood that the metal coil compression device and the metal coil compression binding apparatus according to the present invention are not limited to the foregoing embodiment, and various modifications can be made without departing from the gist of the present invention.

For example, while the foregoing embodiment has described the case of steel strip binding, PET hoop binding may also be used.

The invention claimed is:

1. A metal coil compression device configured to axially compress a metal coil placed with an axis thereof vertical to bind the metal coil with a binding band, the metal coil compression device comprising:

a lifting device configured to generate a vertically downward pressing force;

a cylindrical outer pressure barrel that is supported by the lifting device, the cylindrical outer pressure barrel being configured to move vertically, the cylindrical outer pressure barrel having an opening opened vertically downward on a bottom thereof;

a cylindrical inner pressure barrel that is located inside a peripheral wall of the outer pressure barrel;

a connecting mechanism that is located between the inner pressure barrel and the outer pressure barrel, and connects the inner and outer pressure barrels so that the inner and outer pressure barrels are vertically engaged and are supported relatively rotatably in a circumferential direction, a placing table on which the metal coil is placed; and a rotation mechanism configured to rotate the placing table with the inner pressure barrel;

wherein the outer pressure barrel has an outer recess in the peripheral wall of the outer pressure barrel, the outer recess being recessed vertically upward from a bottom end, and the inner pressure barrel has;

an inner recess in a peripheral wall of the inner pressure barrel, the inner recess being recessed vertically upward from a bottom end; and a coil pressing surface that is located at the bottom end of the peripheral wall of the inner pressure barrel and makes contact with a top of the metal coil to transmit the vertically downward pressing force to the metal coil.

2. The metal coil compression device according to claim 1, wherein the inner pressure barrel has a plurality of the inner recesses in the circumferential direction.

3. A metal coil compression binding apparatus comprising:

a metal coil compression device configured to axially compress a metal coil placed with an axis thereof vertical to bind the metal coil with a binding band, the metal coil compression device including:

a lifting device configured to generate a vertically downward pressing force;

a cylindrical outer pressure barrel that is supported by the lifting device, the cylindrical outer pressure barrel being configured to move vertically, the cylindrical outer pressure barrel having an opening opened vertically downward on a bottom thereof;

a cylindrical inner pressure barrel that is located inside a peripheral wall of the outer pressure barrel; and a connecting mechanism that is located between the inner pressure barrel and the outer pressure barrel, and connects the inner and outer pressure barrels so that the inner and outer pressure barrels are vertically engaged and are supported relatively rotatably in a circumferential direction; and a binding device that binds the metal coil placed with the axis thereof vertical with the binding band, wherein the outer pressure barrel has an outer recess in the peripheral wall of the outer pressure barrel, the outer recess being recessed vertically upward from a bottom end, the inner pressure barrel has:

an inner recess in a peripheral wall of the inner pressure barrel, the inner recess being recessed vertically upward from a bottom end; and a coil pressing surface that is located at the bottom end of the peripheral wall of the inner pressure barrel and makes contact with a top of the metal coil to transmit the vertically downward pressing force to the metal coil, and the binding device includes a binding band insertion portion configured to insert the binding band into both the outer recess and the inner recess.

4. The metal coil compression binding apparatus according to claim 3, wherein the inner pressure barrel has a plurality of the inner recesses in the circumferential direction.

* * * * *